US010886080B1

(12) United States Patent
Lin

(10) Patent No.: US 10,886,080 B1
(45) Date of Patent: Jan. 5, 2021

(54) PUSHBUTTON FOR A KEYBOARD

(71) Applicant: SUNREX TECHNOLOGY CORP., Taichung (TW)

(72) Inventor: Shih-Pin Lin, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 16/787,101

(22) Filed: Feb. 11, 2020

(30) Foreign Application Priority Data

Nov. 4, 2019 (TW) ..... 108214574 U

(51) Int. Cl.
*H01H 13/7065* (2006.01)
*H01H 3/12* (2006.01)

(52) U.S. Cl.
CPC ..... *H01H 13/7065* (2013.01); *H01H 3/125* (2013.01)

(58) Field of Classification Search
CPC ..... H01H 13/7065; H01H 3/125; H01H 3/12
USPC ..... 200/5 A, 341, 344, 345
See application file for complete search history.

(56) References Cited

U.S. PATENT DOCUMENTS 9,697,965 B2 * 7/2017 Chen ..... H01H 13/705
9,941,072 B1 * 4/2018 Chen ..... H01H 13/14
9,941,073 B2 * 4/2018 Chen ..... H01H 13/703
10,020,140 B2 * 7/2018 Pan ..... H01H 3/125

* cited by examiner

*Primary Examiner* — Anthony R Jiminez
*Assistant Examiner* — Lheiren Mae A Caroc
(74) *Attorney, Agent, or Firm* — Burris Law, PLLC

(57) ABSTRACT

A pushbutton includes a base extending in a longitudinal direction, a sensor module mounted to the base, a keycap disposed above the sensor module, two scissor switch modules, a main pushbutton module and two side pushbutton modules. The sensor module has a first sensing member and two second sensing members. The main pushbutton module is operable to switch between a released state, where the main pushbutton module is not in direct contact with the first sensing member such that each of the scissor switch modules would not be in direct contact with a respective one of the second sensing members, and a depressed state, where the main pushbutton module comes in direct contact with the first sensing member.

8 Claims, 11 Drawing Sheets

PUSHBUTTON FOR A KEYBOARD

CROSS-REFERENCE TO RELATED APPLICATION

This application claims priority of Taiwanese Patent Application No. 108214574, filed on Nov. 4, 2019.

FIELD

The disclosure relates to a pushbutton, and more particularly to a pushbutton for a keyboard.

BACKGROUND

A conventional pushbutton includes a base, three spaced-apart sensing members mounted to the base, a keycap disposed above the sensing members, and three switch modules respectively corresponding in position to the sensing members. Each of the switch modules has an elastic member that is supported between the keycap and the base, and a protrusion that extends from the elastic member toward a respective one of the sensing members.

When the keycap has been pressed, the keycap would push against the elastic members of the switch modules, such that the protrusions thereof would abut against respective sensing members to signal that stress has been exerted onto the keycap. As the switch modules are spaced apart along the keycap, the switch modules ensure that stress applied to different portions of the keycap would be properly detected.

However, as the elasticity of each of the elastic members that are connected to the same keycap may vary from one another due to assembly error, some portions of the keycap may be easier or harder to press in comparison to the other portions, which may feel rather uncomfortable.

SUMMARY

Therefore, an object of the disclosure is to provide a pushbutton that can alleviate the drawback of the prior art.

According to the disclosure, the pushbutton for a keyboard includes a base extending in a longitudinal direction, a sensor module, a keycap disposed above the sensor module, two side pushbutton modules, two scissor switch modules, and a main pushbutton module. The sensor module includes a first sensing member that is mounted to a top surface of the base and that is for sensing stress exerted thereto, and two second sensing members that are respectively disposed at two opposite sides of the first sensing member in the longitudinal direction. Each of the side pushbutton modules corresponds in position to a respective one of the second sensing members, and has a dome-shaped side cover that is resiliently mounted to the base and that covers the respective one of the second sensing members, and a side protrusion that protrudes from an inner surface of the side cover and that extends toward the respective one of the second sensing members. Each of the scissor switch modules corresponds in position to a respective one of the side pushbutton modules, and includes a first scissor frame that is rotatably connected to the base, and a second scissor frame that is rotatably connected to the first scissor frame to define an axis of rotation therebetween and that is rotatably connected to the keycap. The main pushbutton module is resiliently connected between the base and the keycap, and corresponding in position to the first sensing member.

Each of the scissor switch modules is operable to switch between a released state, where the second scissor frame and the keycap are not in direct contact with a respective one of the side covers such that the side protrusion thereof is not in direct contact with the respective one of the second sensing members, and a depressed state, where one of the keycap and the second scissor frame pushes the respective one of the side covers, such that the side protrusion thereof comes in direct contact with the respective one of the second sensing members.

The main pushbutton module is operable to switch between a released state, where the main pushbutton module is not in direct contact with the first sensing member such that each of the scissor switch modules remains in its respective released state, and a depressed state, where the main pushbutton module comes in direct contact with the first sensing member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
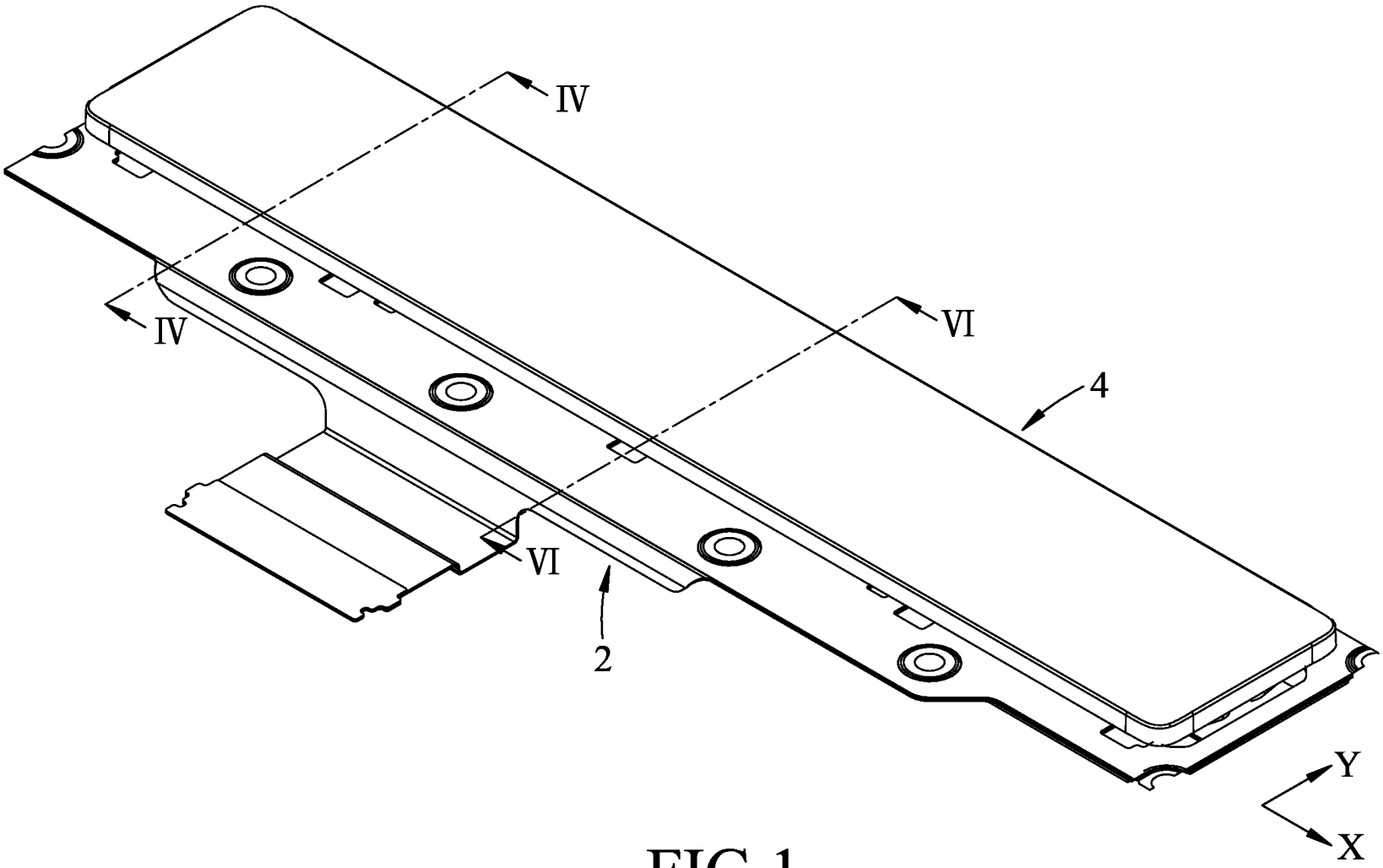
FIG. 1 is a perspective view of a first embodiment of a pushbutton according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
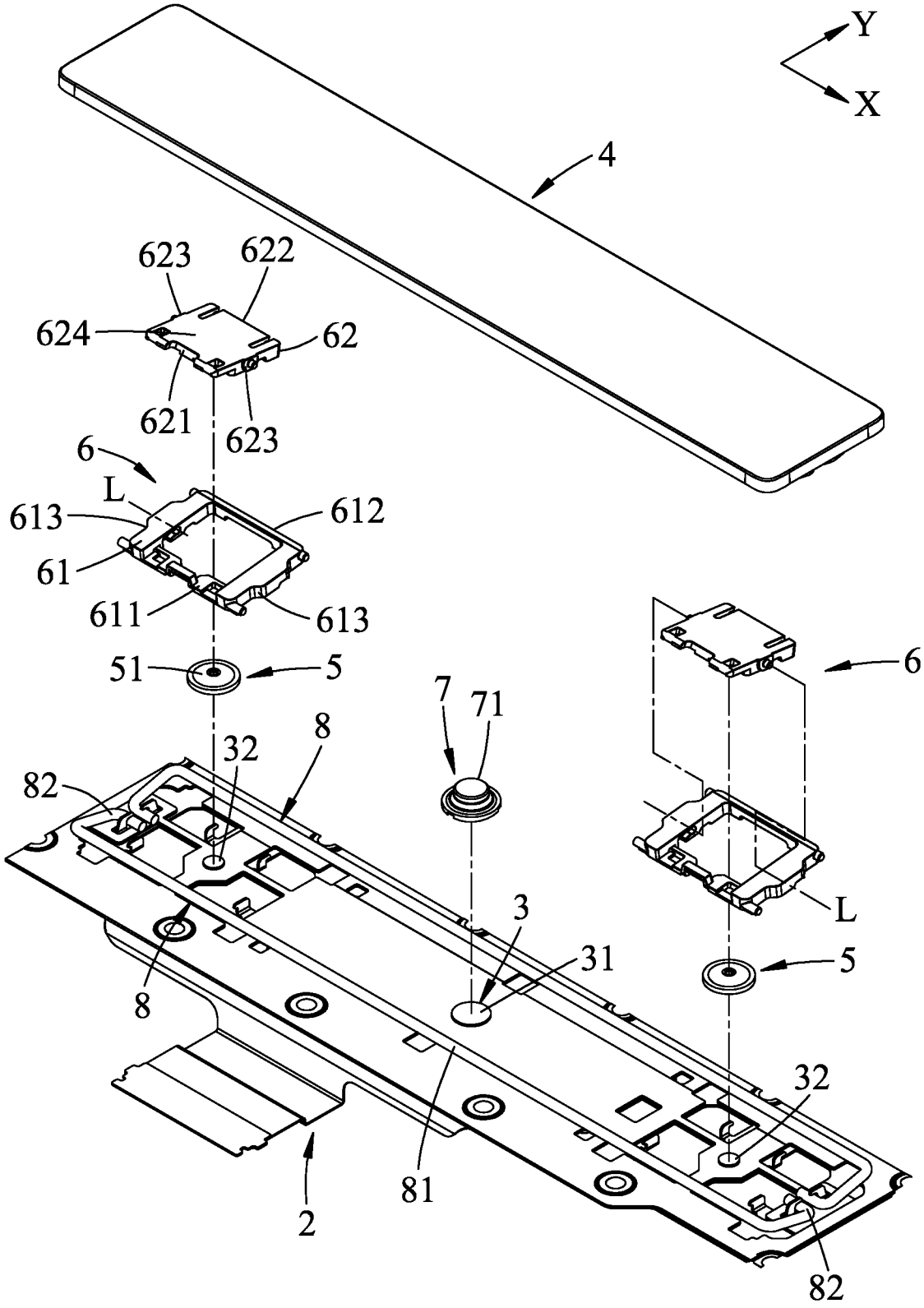
FIG. 2 is an exploded perspective view of the first embodiment.
Figure 3:
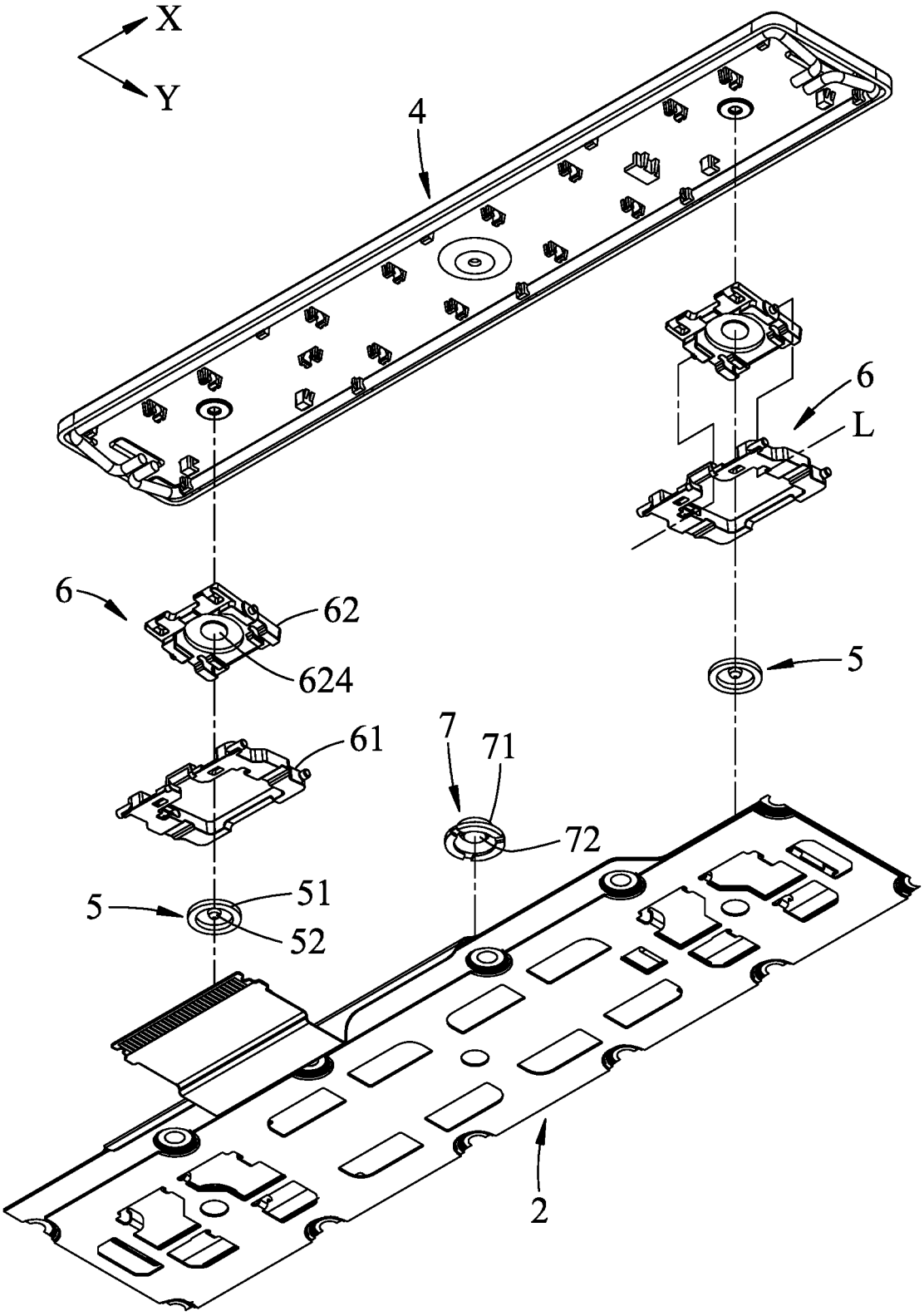
FIG. 3 is another exploded perspective view of the first embodiment.

Referring to FIGS. 1 to 3, a first embodiment of a pushbutton according to the disclosure is for a keyboard, and includes a base 2 that extends in a longitudinal direction (X), a sensor module 3, a keycap 4 that is disposed above the sensor module 3, two side pushbutton modules 5, two scissor switch modules 6 that are mounted to the base 2, a main pushbutton module 7 that is resiliently connected between the base 2 and the keycap 4, and two support rods 8.

The sensor module 3 includes a first sensing member 31 that is mounted to a top surface of the base 2 and that is for sensing stress exerted thereto, and two second sensing members 32 that are respectively disposed at two opposite sides of the first sensing member 31 in the longitudinal direction (X). In this embodiment, the first and second sensing members 31, 32 are piezoresistive pressure sensors, but can be capacitive pressure sensors or other types of pressure sensors in other embodiments.

The side pushbutton modules 5 respectively correspond in position to the second sensing members 32. Each of the side pushbutton modules 5 has a dome-shaped side cover 51 that is resiliently mounted to the base 2 and that covers a respective one of the second sensing members 32, and a side protrusion 52 that protrudes from an inner surface of the side cover 51 and that extends toward the respective one of the second sensing members 32.

The scissor switch modules 6 respectively correspond in position to the side pushbutton modules 5. Each of the scissor switch modules 6 includes a first scissor frame 61 that is rotatably connected to the base 2, and a second scissor frame 62 that is rotatably connected to the first scissor frame 61 to define an axis of rotation (L) therebetween. In this embodiment, the axis of rotation (L) of each of the scissor switch modules 6 extends in the longitudinal direction (X).

The first scissor frame 61 of each of the scissor switch modules 6 has a first bottom portion 611 that is rotatably mounted to the base 2, a first top portion 612 that is proximate to the keycap 4, and two spaced-apart first side portions 613 that interconnect the the first bottom portion 611 and the first top portion 612.

The second scissor frame 62 of each of the scissor switch modules 6 has a second top portion 621 that is rotatably mounted to the keycap 4, a second bottom portion 622 that is slidably movable along the base 2, two spaced-apart second side portions 623 that interconnect the second top portion 621 and the second bottom portion 622 and that are respectively and rotatably connected to the first side portions 613 of the first scissor frame 61, and a central portion 624 that is connected among the second top portion 621, the second bottom portion 622, and the second side portions 623.

The main pushbutton module 7 corresponds in position to the first sensing member 31, and has a dome-shaped main cover 71 that resiliently interconnects the keycap 4 and the base 2 and that covers the first sensing member 31, and a protrusion 72 that protrudes from an inner surface of the main cover 71 and that extends toward the first sensing member 31.

The support rods 8 are spaced apart in a lateral direction (Y) perpendicular to the longitudinal direction (X). Each of the support rods 8 has a support portion 81 that is rotatably mounted to the keycap 4, and two pivot portions 82 that respectively extend from two opposite ends of the support portion 81 and that are rotatably mounted to the base 2.

The pivoting mechanism among the base 2, the keycap 4, the first and second scissor frames 61, 62, and the support rods 8 is commonly known in keyboard assembling, and is therefore not described in details thereafter.

Figure 4:
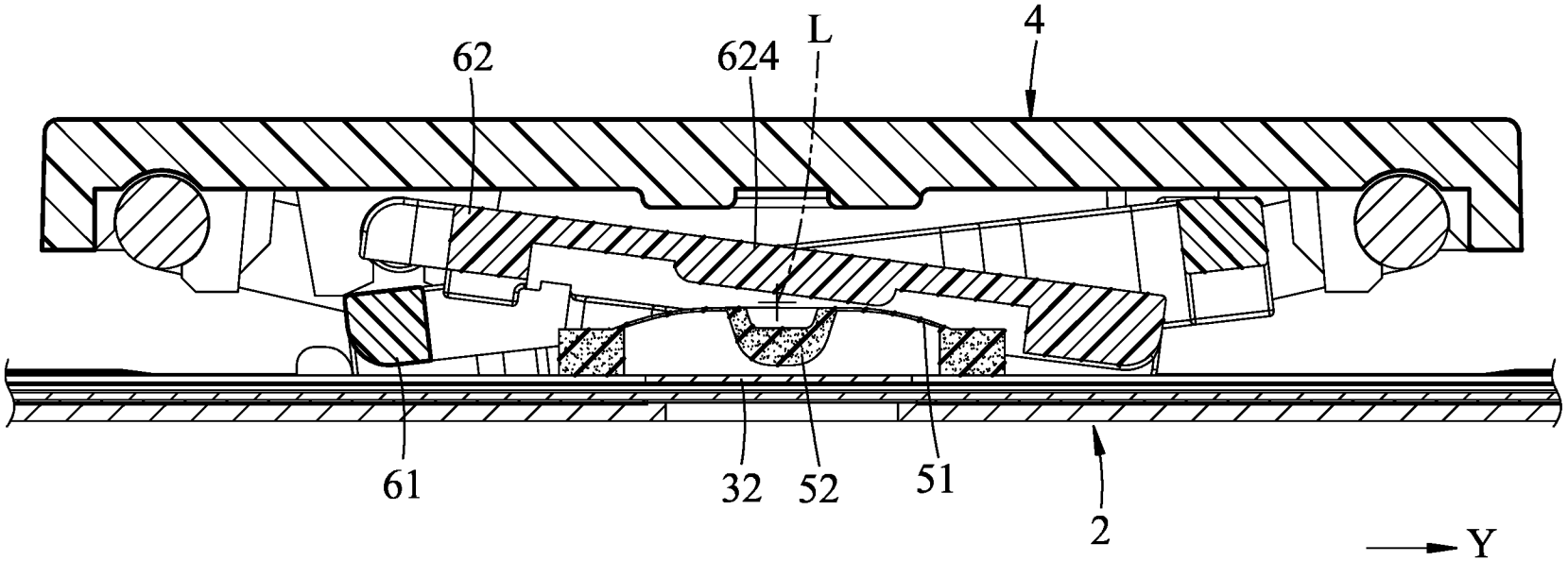
FIG. 4 is a fragmentary sectional view taken along line IV-IV in FIG. 1, illustrating a scissor switch module in a released state.
Figure 5:
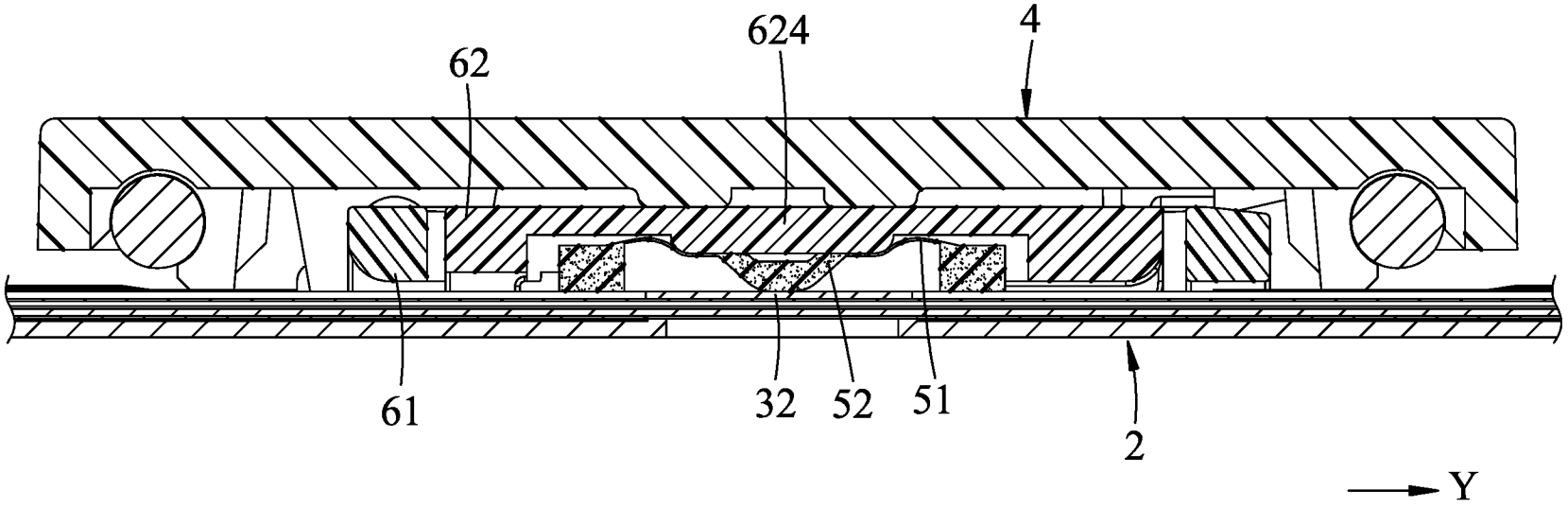
FIG. 5 is a view similar to FIG. 4, illustrating the scissor switch module in a depressed state.

Referring to FIGS. 2, 4 and 5, each of the scissor switch modules 6 is operable to switch between a released state (see FIG. 4), where the keycap 4 is not in direct contact with the central portion 624 of the second scissor frame 62 and where the central portion 624 is not in direct contact with a respective one of the side covers 51, such that the side protrusion 52 of the respective one of the side covers 51 is not in direct contact with the respective one of the second sensing members 32, and a depressed state (see FIG. 5), where the central portion 624 of the second scissor frame 62 is pushed by the keycap 4 to abut against the respective one of the side covers 51, such that the side protrusion 52 thereof comes in direct contact with the respective one of the second sensing members 32, and such that the respective one of the second sensing member 32 detects pressure thereon.

Figure 6:
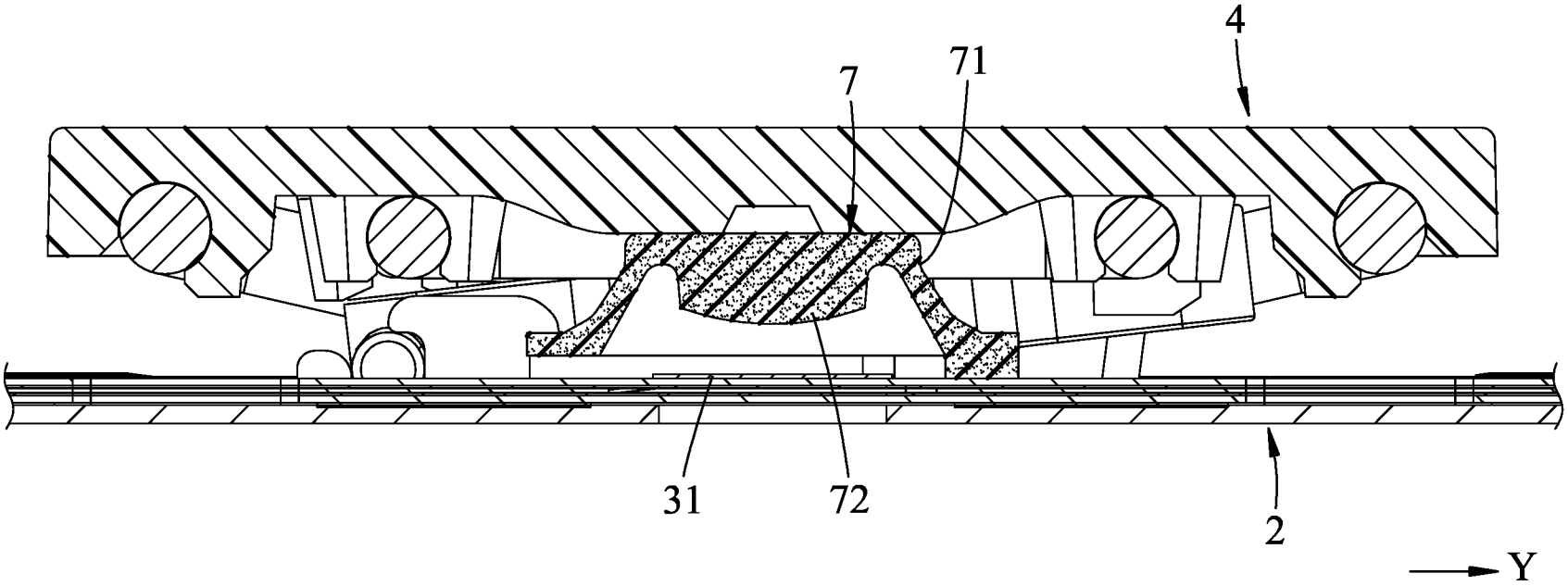
FIG. 6 is a fragmentary sectional view taken along line VI-VI in FIG. 1, illustrating a pushbutton module in a released state.
Figure 7:
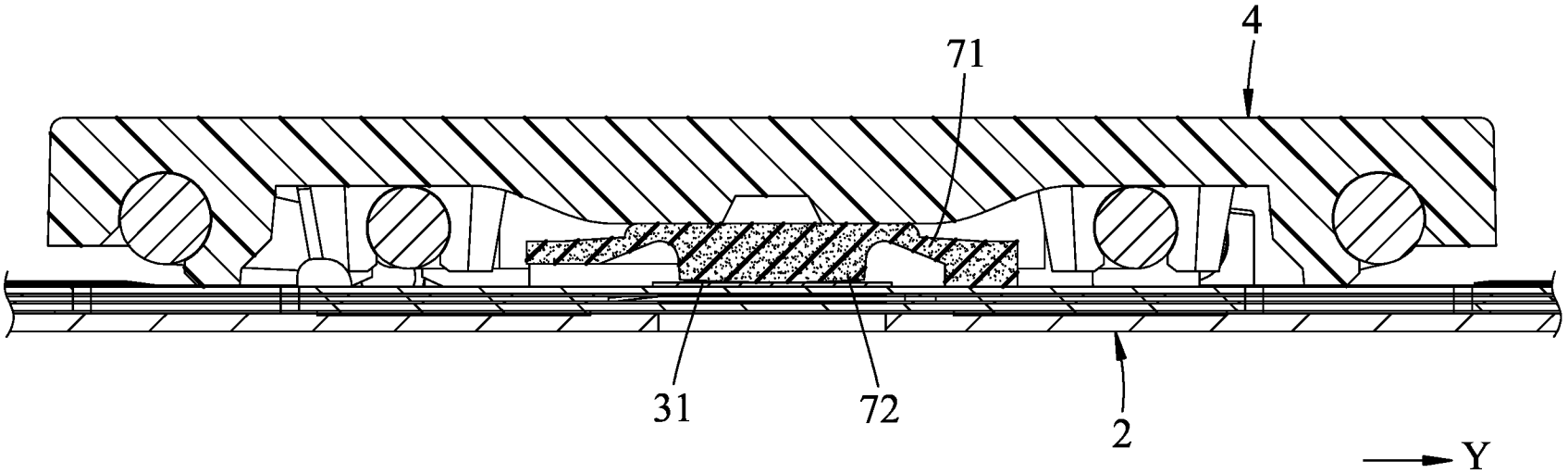
FIG. 7 is a view similar to FIG. 6, illustrating the pushbutton module in a depressed state.

Referring to FIGS. 2, 6 and 7, the main pushbutton module 7 is operable to switch between a released state (see FIG. 6), where the main pushbutton module 7 is not in direct contact with the first sensing member 31 such that each of the scissor switch modules 6 remains in its respective released state, and a depressed state (see FIG. 7), where the main cover 71 of the main pushbutton module 7 is deformed by the keycap 4 and the protrusion 72 comes in direct contact with the first sensing member 31, such that the first sensing member 31 detects pressure thereon.

When a user presses a center portion of the keycap 4, the keycap 4 abuts against the main pushbutton module 7 so that the main pushbutton module 7 is switched to the depressed state, such that the first sensing member 31 detects pressure thereon. When the user no longer presses the keycap 4, the main cover 71 resiliently pushes the keycap 4, such that the main pushbutton module 7 is switched to the released state.

When a user presses a side portion of the keycap 4 instead, the keycap 4 abuts against a corresponding one of the scissor switch modules 6 so that the corresponding one of the scissor switch modules 6 is switched to the depressed state and the main cover 71 of the main pushbutton module 7 is deformed by the keycap 4, such that the respective one of the second sensing members 32 detects pressure thereon. At this time, the other one of the scissor switch modules 6 remains in the released state. When the user no longer presses the keycap 4, the main cover 71 resiliently pushes the keycap 4, such that the scissor switch modules 6 are in the released state.

Overall, since the keycap 4 is considered "being pressed" when any of the first and second sensing members 31, 32 detects pressures thereon, the embodiment ensures that the keystroke of the user is properly detected even if the user does not press the central part of the keycap 4. In addition, as the resilient force to push the keycap 4 back to its original position is done solely by the main cover 71, and the scissor switch modules 6 are only meant to interconnect different elements, the issues of having different elastic members interfering with one another (e.g. exerting varying degree of elastic forces) during use or during assembly would not arise in this embodiment.

Figure 8:
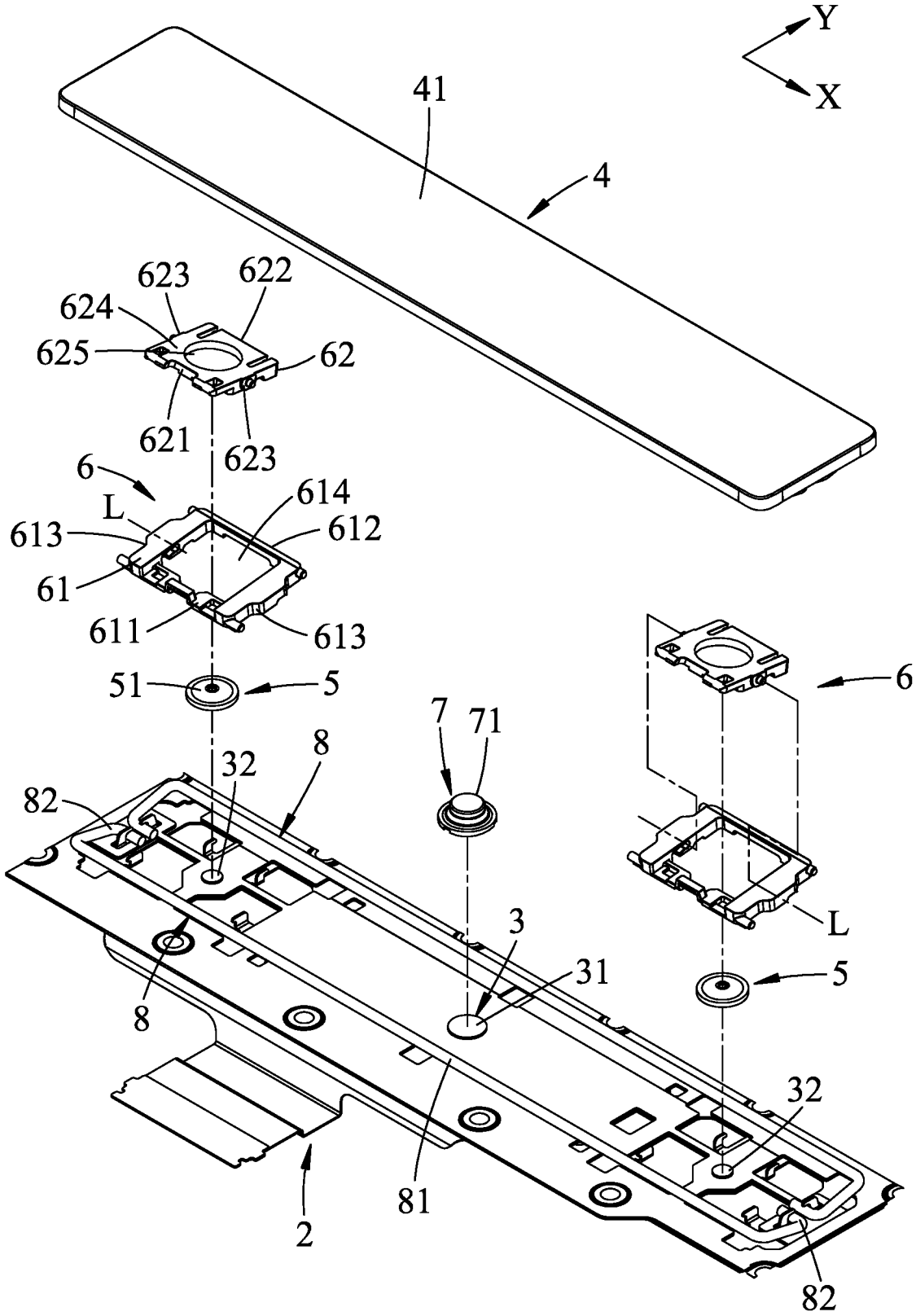
FIG. 8 is an exploded perspective view of a second embodiment of the pushbutton according to the disclosure.
Figure 9:
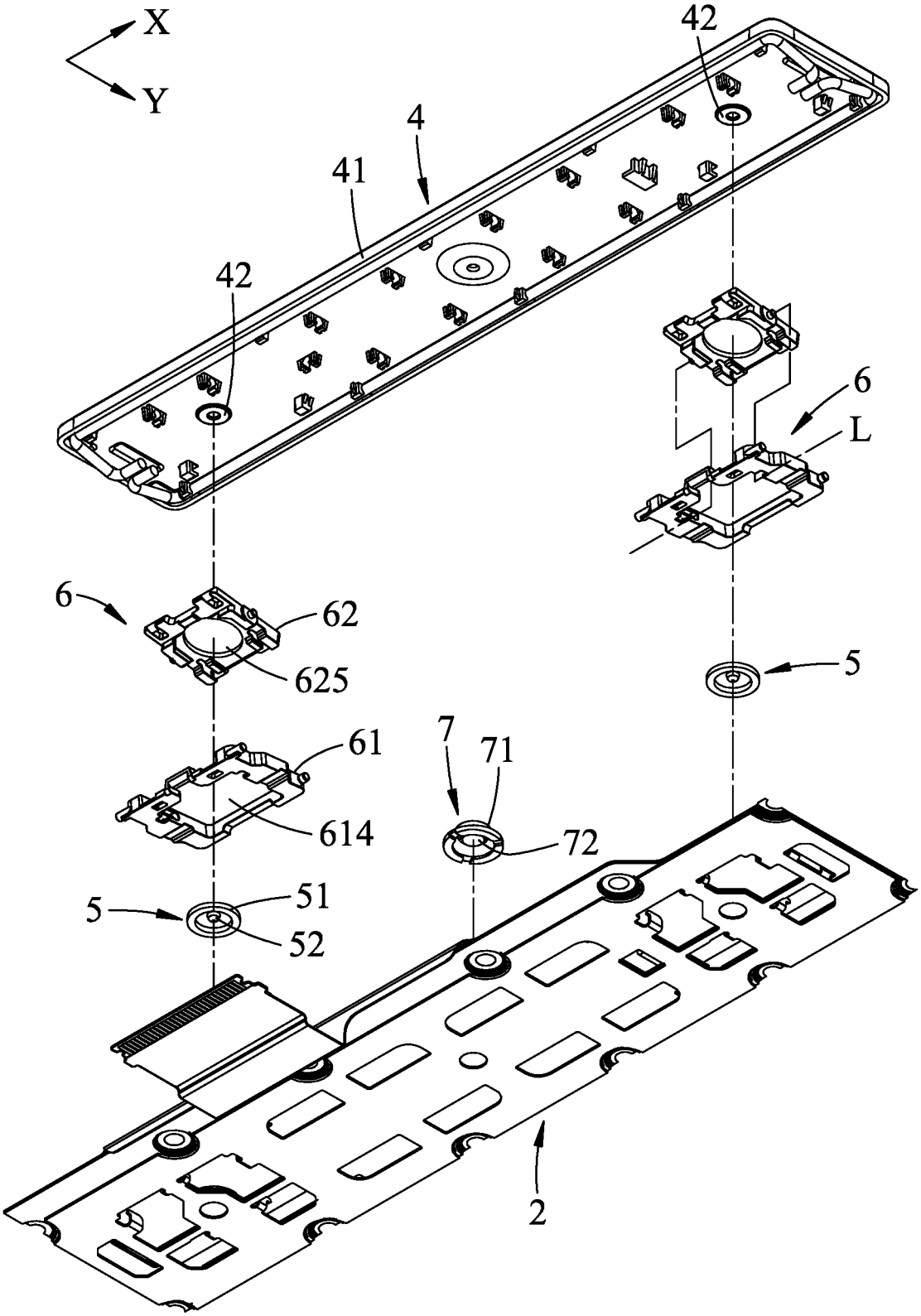
FIG. 9 is another exploded perspective view of the second embodiment.

Referring to FIGS. 8 and 9, a second embodiment of the pushbutton is similar to the first embodiment, with the following differences:

The first scissor frame 61 of each of the scissor switch modules 6 further includes a first through hole 614 that is surrounded by the first top portion 611, the first bottom portion 612, and the first side portions 613 and that corresponds in position to the respective one of the side covers 51. The second scissor frame 62 of each of the scissor switch modules 6 further includes a second through hole 625 that extends through the central portion 624 and that corresponds in position to the respective one of the side covers 51.

The keycap 4 has a contact portion 41, and two abutment portions 42 that are spaced apart in the longitudinal direction (X) and that are mounted to a bottom surface of the contact portion 41. The abutment portions 42 are permitted to respectively extend through the first through holes 614 and through the second through holes 625.

Figure 10:
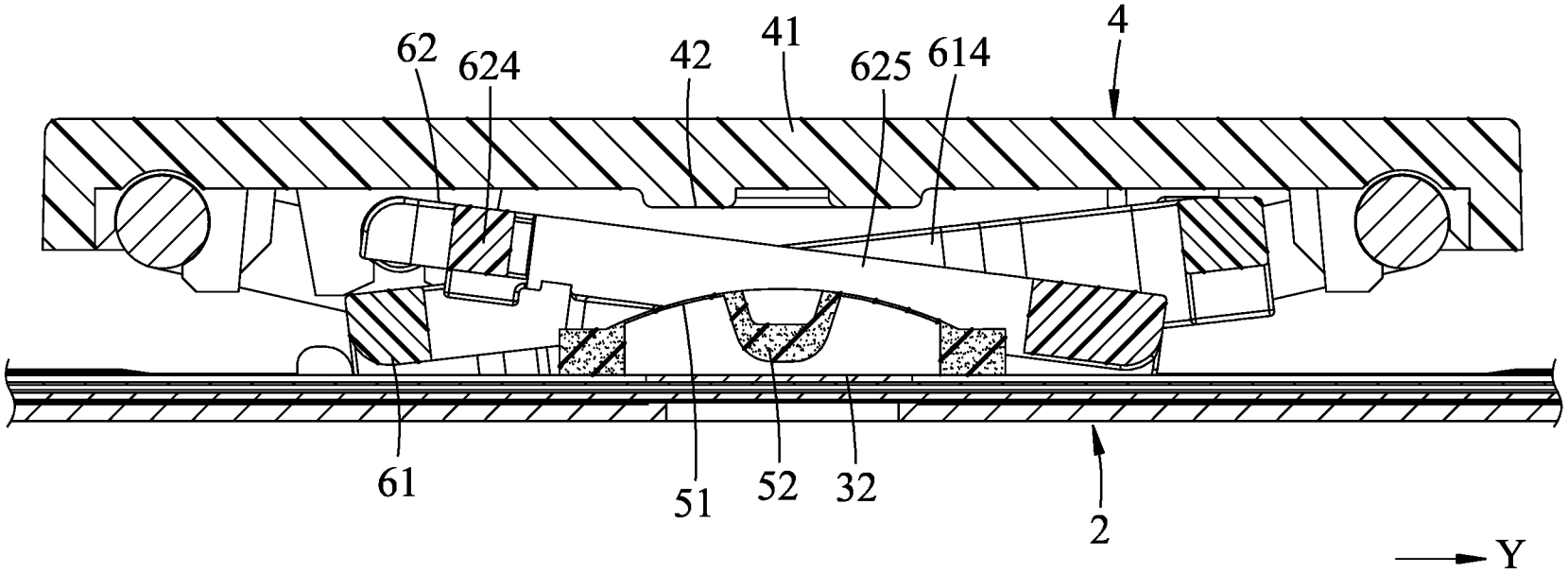
FIG. 10 is a fragmentary sectional view of the second embodiment, illustrating the scissor switch module in a released state.
Figure 11:
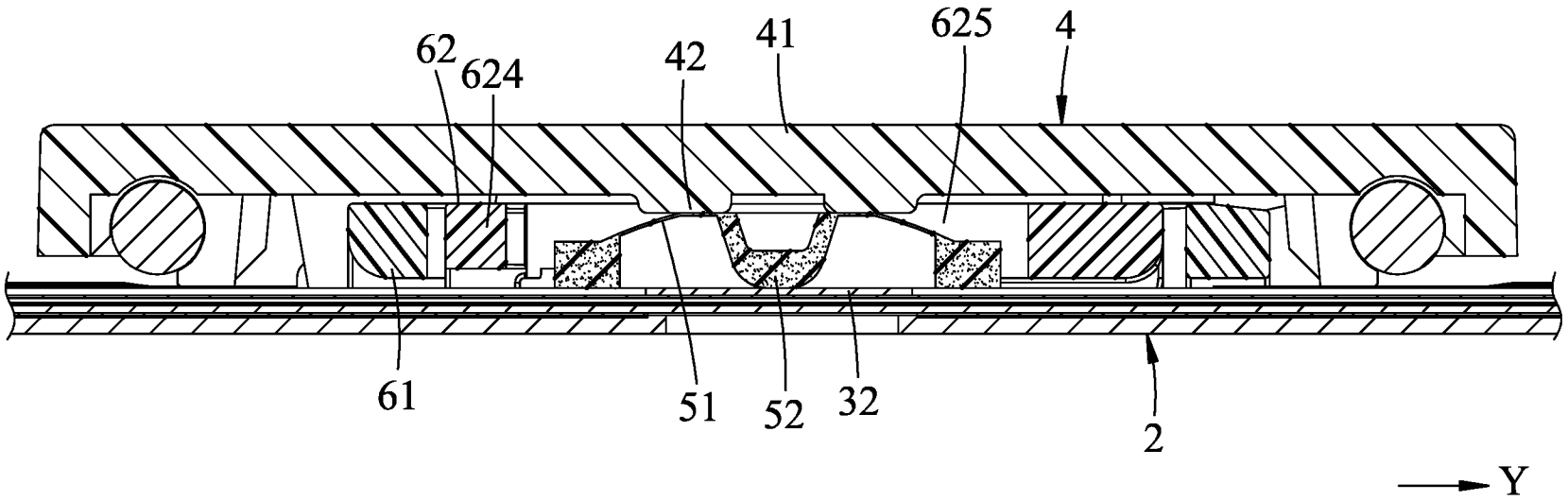
FIG. 11 is a view similar to FIG. 10, illustrating the scissor switch module in a depressed state.

Referring to FIGS. 8, 10 and 11, when each of the scissor switch modules 6 is in the released state (see FIG. 10), the keycap 4 is not in direct contact with the central portion 624 of the second scissor frame 62, and each of the abutment portions 42 of the keycap 4 is not in contact with the respective one of the side covers 51. When each of the scissor switch modules 6 is in the depressed state (see. FIG. 11), the scissor switch module 6 is pushed by the keycap 4, and each of the abutment portions 42 the keycap 4 extends through a space cooperatively defined by respective ones of the first and second through holes 614, 625 to abut against the respective one of the side covers 51, such that the side protrusion 52 thereof comes in direct contact with the respective one of the second sensing members 32.

It should be noted that in other embodiments, it can designed in such way that the side covers 51 extends through the space cooperatively defined by respective ones of the first and second through holes 614, 625 instead for the side covers 51 to be pushed by the keycap 4, such that the side protrusion 52 thereof comes in direct contact with the respective one of the second sensing members 32. As such, the second embodiment offers the same benefits as that of the first embodiment.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pushbutton for a keyboard, said pushbutton comprising:

a base extending in a longitudinal direction;

a sensor module including a first sensor that is mounted to a top surface of said base and that is for sensing stress exerted thereto, and two second sensors that are respectively disposed at two opposite sides of said first sensor in the longitudinal direction;

a keycap disposed above said sensor module;

two side pushbutton modules respectively corresponding in position to said second sensors, each of said side pushbutton modules having a dome-shaped side cover that is resiliently mounted to said base and that covers a respective one of said second sensors, and a side protrusion that protrudes from an inner surface of said side cover and that extends toward the respective one of said second sensors;

two scissor switch modules respectively corresponding in position to said side pushbutton modules, each of said scissor switch modules including a first scissor frame that is rotatably connected to said base, and a second scissor frame that is rotatably connected to said first scissor frame to define an axis of rotation therebetween, and that is rotatably connected to said keycap; and a main pushbutton module resiliently connected between said base and said keycap, and corresponding in position to said first sensor;

wherein, each of said scissor switch modules is operable to switch between a released state, where said second scissor frame and said keycap are not in direct contact with a respective one of said side covers such that said side protrusion thereof is not in direct contact with the respective one of said second sensors, and a depressed state, where one of said keycap and said second scissor frame pushes the respective one of said side covers such that said side protrusion thereof comes in direct contact with the respective one of said second sensors; and wherein, said main pushbutton module is operable to switch between a released state, where said main pushbutton module is not in direct contact with said first sensor such that each of said scissor switch modules remains in its respective released state, and a depressed state, where said main pushbutton module comes in direct contact with said first sensor.

2. The pushbutton as claimed in claim 1, wherein:

said first scissor frame of each of said scissor switch modules has a first bottom portion that is rotatably mounted to said base, a first top portion that is proximate to said keycap, and two spaced-apart first side portions that interconnect said first bottom portion and said first top portion; and said second scissor frame of each of said scissor switch modules has a second top portion that is rotatably mounted to said keycap, a second bottom portion that is slidably movable along said base, two spaced-apart second side portions that interconnect said second top portion and said second bottom portion and that are respectively and rotatably connected to said first side portions of said first scissor frame of said scissor switch module, and a central portion that is connected among said second top portion, said second bottom portion, and said second side portions.

3. The pushbutton as claimed in claim 2, wherein:

said central portion of said second scissor frame of each of said scissor switch modules is disposed above the respective one of said side covers;

when each of said scissor switch modules is in the released state, said central portion is not in direct contact with the respective one of said side covers;

when each of said scissor switch modules is in the depressed state, said central portion is pushed by said keycap to abut against the respective one of said side covers, such that said side protrusion thereof comes in direct contact with the respective one of said second sensors.

4. The pushbutton as claimed in claim 2, wherein:

said first scissor frame of each of said scissor switch modules further includes a first through hole that is surrounded by said first top portion, said first bottom portion, and said first side portions and that corresponds in position to the respective one of said side covers;

said second scissor frame of each of said scissor switch modules further includes a second through hole that extends through said central portion and that corresponds in position to the respective one of said side covers;

when each of said scissor switch modules is in the released state, said keycap is not in direct contact with said side covers; and when each of said scissor switch modules is in the depressed state, at least one of said keycap and said side covers extends through a space cooperatively defined by respective ones of said first and second through holes, such that at least one of said side covers is pushed by said keycap and that said side protrusion thereof comes in direct contact with the respective one of said second sensors.

5. The pushbutton as claimed in claim 4, wherein:

said keycap has a contact portion and two abutment portions that are spaced apart in the longitudinal direction, that are mounted to a bottom surface of said keycap, and that are permitted to respectively extend through said first through holes and through said second through holes.

6. The pushbutton as claimed in claim 1, wherein:

said main pushbutton module includes a dome-shaped main cover that resiliently interconnects said keycap and said base and that covers said first sensor, and a main protrusion that protrudes from an inner surface of said main cover and that extends toward said first sensor.

7. The pushbutton as claimed in claim 1, further comprising two support rods that are spaced apart in a lateral direction perpendicular to the longitudinal direction, each of said support rods having a support portion that is rotatably mounted to said keycap, and two pivot portions that respectively extend from two opposite ends of said support portion and that are rotatably mounted to said base.

8. The pushbutton as claimed in claim 1, wherein the axis of rotation of each of said scissor switch modules extends in the longitudinal direction.

* * * * *